US009248994B2

(12) United States Patent
Grundmann

(10) Patent No.: US 9,248,994 B2
(45) Date of Patent: Feb. 2, 2016

(54) ELEVATOR SYSTEM WITH ELEVATOR CARS WHICH CAN MOVE VERTICALLY AND HORIZONTALLY

(75) Inventor: Steffen Grundmann, Bonstetten (CH)

(73) Assignee: Inventio AG, Hergiswil (CH)

( * ) Notice: Subject to any disclaimer, the term of this patent is extended or adjusted under 35 U.S.C. 154(b) by 1029 days.

(21) Appl. No.: 12/747,692

(22) PCT Filed: Dec. 11, 2008

(86) PCT No.: PCT/EP2008/067271

§ 371 (c)(1),
(2), (4) Date: Aug. 12, 2010

(87) PCT Pub. No.: WO2009/074627

PCT Pub. Date: Jun. 18, 2009

(65) Prior Publication Data

US 2011/0042168 A1 Feb. 24, 2011

(30) Foreign Application Priority Data

Dec. 11, 2007 (EP) ..... 07122912

(51) Int. Cl.
*B66B 9/00* (2006.01)

(52) U.S. Cl.
CPC ..... *B66B 9/00* (2013.01)

(58) Field of Classification Search
CPC ..... B66B 9/003; B66B 9/00; B66B 9/02; B66B 11/0407; B66B 1/2466
USPC ..... 187/249
See application file for complete search history.

(56) References Cited

U.S. PATENT DOCUMENTS

| | | | | | |
|---|---|---|---|---|---|
| 1,859,483 | A * | 5/1932 | Winslow | 198/798 |
| 3,317,005 | A * | 5/1967 | Kehoe | 187/249 |
| 3,658,155 | A * | 4/1972 | Salter | 198/798 |
| 4,946,006 | A * | 8/1990 | Kume | 187/249 |
| 5,419,414 | A * | 5/1995 | Sakita | 187/391 |
| 5,758,748 | A * | 6/1998 | Barker et al. | 187/249 |
| 5,829,553 | A * | 11/1998 | Wan et al. | 187/401 |
| 6,354,404 | B1 * | 3/2002 | Sansevero et al. | 187/249 |
| 6,955,245 | B2 * | 10/2005 | Dunser et al. | 187/382 |
| 7,537,089 | B2 * | 5/2009 | Duenser et al. | 187/249 |
| 7,621,376 | B2 * | 11/2009 | Duenser et al. | 187/249 |
| 2006/0163008 | A1 * | 7/2006 | Godwin | 187/288 |
| 2007/0181374 | A1 * | 8/2007 | Mueller | 187/249 |

FOREIGN PATENT DOCUMENTS

EP 1693331 A1 8/2006

* cited by examiner

*Primary Examiner* — William A Rivera
*Assistant Examiner* — Michael Riegelman
(74) *Attorney, Agent, or Firm* — Fraser Clemens Martin & Miller LLC; William J. Clemens

(57) ABSTRACT

An elevator system has an elevator car which can move vertically along a vertical track having a vertical guide rail, and can move horizontally utilizing a car transfer device. The car transfer device has a horizontal displacement unit into which a vertical guide rail piece can be integrated, the guide rail piece guiding the elevator car in the horizontal displacement unit. The horizontal displacement unit can be positioned so that the guide rail piece forms a section of the vertical guide rail. The elevator car can be fixed on the guide rail piece during the horizontal displacement by a brake device.

21 Claims, 4 Drawing Sheets

Fig. 6 (Section VI-VI)
Fig. 7 (Section VII-VII)
40
45
46
47
49
50
51
52
53
55
56
57
58
59
60
61
62
8
VI
VII

ELEVATOR SYSTEM WITH ELEVATOR CARS WHICH CAN MOVE VERTICALLY AND HORIZONTALLY

FIELD OF THE INVENTION

The invention relates to an elevator system with an elevator car which can move vertically and horizontally.

BACKGROUND OF THE INVENTION

EP1693331A1 discloses an elevator system with vertical tracks which are formed by two car guide rails in each case, in which the vertical tracks extend between a lowermost stopping station and an uppermost stopping station and are each equipped with at least one separately controllable drive system. Each drive system comprises a flexible supporting means extending over the entire length of the vertical tracks. This elevator system also includes a plurality of elevator cars which are movable and stoppable upward along the first vertical track and downward along the second vertical track by means of the drive systems. In this case, each elevator car has a controllable coupling mechanism with which said elevator car can be coupled in an interlocking manner to the supporting means of a drive system assigned to the present vertical track thereof. An upper and a lower car transfer mechanism have the task of taking over elevator cars which have arrived in the end regions of the vertical tracks and of displacing said elevator cars horizontally to the other vertical track where the elevator cars are introduced into the guide rails of the other vertical track.

In an elevator system designed in accordance with the teaching disclosed in EP1693331A1, all of the elevator cars are equipped with in each case four upper and four lower car supporting rollers which are mounted on pivotable supporting structures in order to permit horizontal displacement of said elevator cars between two vertical tracks. When an elevator car has reached the uppermost position thereof, the four upper car supporting rollers thereof are pivoted, for the horizontal displacement, into a profile rail, which is arranged horizontally above the vertical tracks, such that the elevator car is supported and guided by the profile rail and the car supporting rollers. After an elevator car has arrived in the lowermost position thereof, the lower car supporting rollers thereof are pivoted into a profile rail, which is arranged horizontally below the vertical tracks, so that the elevator car is displaceable horizontally on said lower profile rail. In addition, in both end positions, a drive device (not illustrated in the drawing) is required to produce the horizontal movement of the elevator cars. Similarly, in order to permit the horizontal displacement of the elevator cars, in the case of the disclosed elevator system having two vertical tracks, a total of eight end sections of car guide rails are arranged pivotably and are provided with controllable pivoting drives. When said end sections are pivoted back into the guide positions thereof, the end sections have to be introduced again into the guide grooves, which have little play, of the guide shoes which are present on the elevator car which is not highly dimensionally stable. For an additional vertical track, the number of car guide rails which can be pivoted away would be increased by eight.

SUMMARY OF THE INVENTION

The present invention is based on the object of providing an elevator system of the above-described type, in which the horizontal displacement of the elevator cars can be realized with a smaller number of components to be moved and to be controlled and without accuracy problems, i.e. with both greater functional reliability and lower manufacturing and installation costs.

In the case of the elevator system according to the invention and according to the method according to the invention, an elevator car can move vertically and horizontally, wherein vertical movements take place along a vertical track comprising a vertical guide rail, and horizontal movements are carried out with the aid of a car transfer mechanism, wherein the car transfer mechanism comprises a horizontal displacement unit into which a vertical guide rail piece is integrated, said guide rail piece guiding the elevator car in the horizontal displacement unit, and wherein the horizontal displacement unit can be positioned in such a manner that the guide rail piece forms a section of the vertical guide rail.

A substantial advantage of the elevator system according to the invention and of the method according to the invention is that the elevator car is displaced horizontally without the guide shoes thereof having to leave the vertical guide rails and having to be introduced into other vertical guide rails. Accuracy problems are therefore avoided. Further advantages of the solution according to the invention consist in that the horizontal displacement of the elevator car does not require the elevator cars to be equipped with lower and upper supporting rollers and that the horizontal displacement can be realized with a considerably smaller number of components to be moved and to be controlled, this resulting in greater functional reliability of the elevator system and in lower manufacturing and installation costs.

The elevator car advantageously has a brake mechanism with which said elevator car can be temporarily fixed to the guide rail piece integrated in the horizontal displacement unit of the car transfer mechanism. With said fixing of the elevator car in the abovementioned horizontal displacement unit, an extremely simple transfer of the elevator car from the vertical track thereof into the horizontal displacement unit, and vice versa, can be realized.

Advantageously, the brake mechanism of the elevator car can be activated and can be deactivated by a control mechanism, for example by the elevator controller. Activation or deactivation can be controlled, for example, as a function of the detected presence of the elevator car on the guide rail piece integrated in the horizontal displacement unit.

The brake mechanism can advantageously also serve as a catch brake for the elevator car. A brake of this type permits, for example, the elevator car to be braked in the event of it being detected that a permissible speed or a permissible acceleration is being exceeded. By means of a combination of the catch brake with the brake mechanism required for fixing the elevator car during the horizontal displacement thereof, the total costs of the elevator system are considerably reduced.

The controllable brake mechanism may advantageously also serve as a holding brake for the elevator car. A holding brake of this type fixes the elevator car on the vertical guide rail of the vertical track during a floor stop, in order to avoid vertical displacements as a consequence of changes in load, and vertical oscillations.

The elevator system advantageously comprises two or more vertical tracks, wherein the elevator car is displaceable between said vertical tracks with the aid of the car transfer mechanism. In the case of an elevator system of this type, the elevator car or a plurality of elevator cars can travel along a plurality of vertical tracks, wherein certain vertical tracks are preferably used for the upward trip and certain vertical tracks for the downward trip.

The vertical tracks are advantageously arranged offset with respect to each other parallel to a car wall of the at least one elevator car, said car wall having a car door. This solution permits elevator systems in which at least one elevator car can run in a plurality of vertical tracks arranged next to one another, wherein the passengers enter and exit on the same side of the elevator cars on each floor. This has the advantage that in each case only a single shaft door is required per vertical track and floor.

The horizontal displacement unit of the car transfer mechanism is advantageously displaceable along horizontal guides which are arranged parallel to the car wall having a car door in a region of the elevator shaft which is not taken up by the vertically and horizontally moving elevator car. An embodiment of this type is particularly expedient in particular in elevator configurations having a multiplicity of vertical tracks and/or long horizontal displacement paths.

The at least one elevator car advantageously has two mutually opposite car walls each having a car door, and the vertical tracks are arranged offset with respect to each other at right angles to said car walls. In this embodiment which is suitable in particular for elevator systems having only two vertical tracks, a first vertical track is expediently used for upward trips and a second vertical track for downward trips. It follows therefrom that, from each floor, there is one entry vestibule for upward trips and one entry vestibule for downward trips, said entry vestibules being separated from one another by the elevator shaft. The advantage of this embodiment is that a more orderly flow of traffic can be achieved by separating the waiting areas for upward trips from the waiting areas for downward trips.

An elevator system advantageously has a plurality of car transfer mechanisms which are arranged on different levels in such a manner that the guide rail pieces which are integrated in the horizontal displacement units thereof can form displaceable end sections or intermediate sections of vertical guide rails of two or more vertical tracks. With an elevator system of this type, particularly high transport capacities can be achieved.

At least one vertical track is advantageously equipped with a car drive system which comprises a flexible supporting means which is movable and stoppable along the vertical track, wherein the elevator car has a controllable coupling mechanism with which the elevator car can be coupled to or decoupled from the supporting means. A coupling or decoupling operation of this type takes place in each case after the elevator car has been fitted with the aid of a car transfer mechanism into the vertical track or before said elevator car is displaced horizontally out of the vertical track by a car transfer mechanism.

The supporting means and the coupling mechanism are advantageously designed in such a manner that the elevator car and the supporting means are coupled by means of interlocking engagement. Coupling by means of interlocking engagement ensures a particularly reliable connection, but requires a supporting means which is equipped with certain interlocking elements, such as, for example, holes or bosses.

The supporting means and the coupling mechanism are advantageously designed in such a manner that the elevator car and the supporting means are coupled by means of frictional engagement. The effect achieved by this is that every point of the supporting means can be used as a coupling point, and that the position of the supporting means does not need to be aligned with the car position prior to a coupling operation.

The drive system advantageously comprises a drive unit with a speed-controllable electric motor, wherein the electric motor drives a driving pulley acting on the supporting means or a driving shaft which has an effective diameter of less than 100 mm, preferably of less than 80 mm. Such small effective diameters of the driving pulley permit a transmission-free driving of the supporting means by electric motors which take up little installation space.

Each drive system advantageously comprises two flexible supporting means arranged parallel. The functional reliability of the elevator system is increased by the use of in each case two supporting means acting redundantly on an elevator car.

Each drive system advantageously comprises an upper and a lower drive unit which can be controlled and regulated synchronously and jointly act on the at least one supporting means of the drive system. With said measure, the traction capability and the functional reliability of the elevator system are increased.

The at least one supporting means of the drive system is advantageously designed as a flat belt, V-ribbed belt or toothed belt. Supporting means of this type have excellent traction properties and are particularly readily suitable for interaction with controllable coupling mechanisms.

The coupling mechanism acting by means of frictional engagement advantageously comprises a clamping device which is movable out of the region of the drive belts in order to permit a horizontal transfer of the elevator car.

Said drive system advantageously operates without a counterweight. The effect achieved by this is that the elevator cars which virtually always move in the same traveling direction in a vertical track can be coupled to the drive system without a counterweight having to be brought beforehand into a certain starting position.

The drive system advantageously comprises a drive regulator which, during a downward trip of an elevator car, feeds the energy generated into the mains or temporarily stores said energy in capacitors or in an accumulator for reuse. This measure makes it possible to prevent the absence of a counterweight from resulting in increased energy consumption.

A vertical track is advantageously equipped with two or more drive systems arranged parallel to each other in order to be able to receive two or more elevator cars simultaneously, wherein the elevator cars have two or more controllable coupling mechanisms with which the elevator cars can be coupled to a separately controllable drive system presently assigned thereto. One such refinement of the elevator system makes it possible to move two or more elevator cars simultaneously on the at least one vertical track without a floor stop of one elevator car forcing the synchronous stopping of the other elevator car(s).

A code scale with absolute encoding is advantageously arranged along a vertical track, each elevator car being assigned a code reading mechanism which continuously reads information about the position of the elevator car from the code scale by means of detectors functioning in a contact-free manner. This mechanism supplies the elevator controller with the required information in order to have the current positions and movement data of all the elevator cars of the elevator system available in every operating situation.

A rotary sensor is advantageously attached to the elevator car and is driven by a friction wheel rolling along the vertical guide rail or along a guide rail section of a horizontal displacement unit, the rotary sensor supplying information about the present traveling speed to a monitor. This redundant information about the current traveling speed of the elevator car serves to generally increase the functional reliability of the elevator system.

The monitor advantageously redundantly monitors the traveling speed and/or the present acceleration of the elevator car with reference to the information transmitted by the rotary sensor and also by means of continuous differentiation of the travel path determined from the position information and, if it is detected that a speed limit or acceleration limit is being exceeded, activates the controllable brake mechanism as a catch brake. In particular if the monitor is installed on the elevator car, said monitor can activate the catch brake with the greatest possible reaction speed and functional reliability in the event of an emergency, with redundant activation by evaluation of the information from the code scale contributing to a further increase in the functional reliability of the catch brake.

DESCRIPTION OF THE DRAWINGS

Exemplary embodiments of the invention are explained below with reference to the attached drawings.

FIGS. 4-7 show a side view, a top view and two cross sections of a coupling mechanism which couples an elevator car to the supporting means in a frictionally engaged manner.

DESCRIPTION OF PREFERRED EMBODIMENTS

Figure 1A:
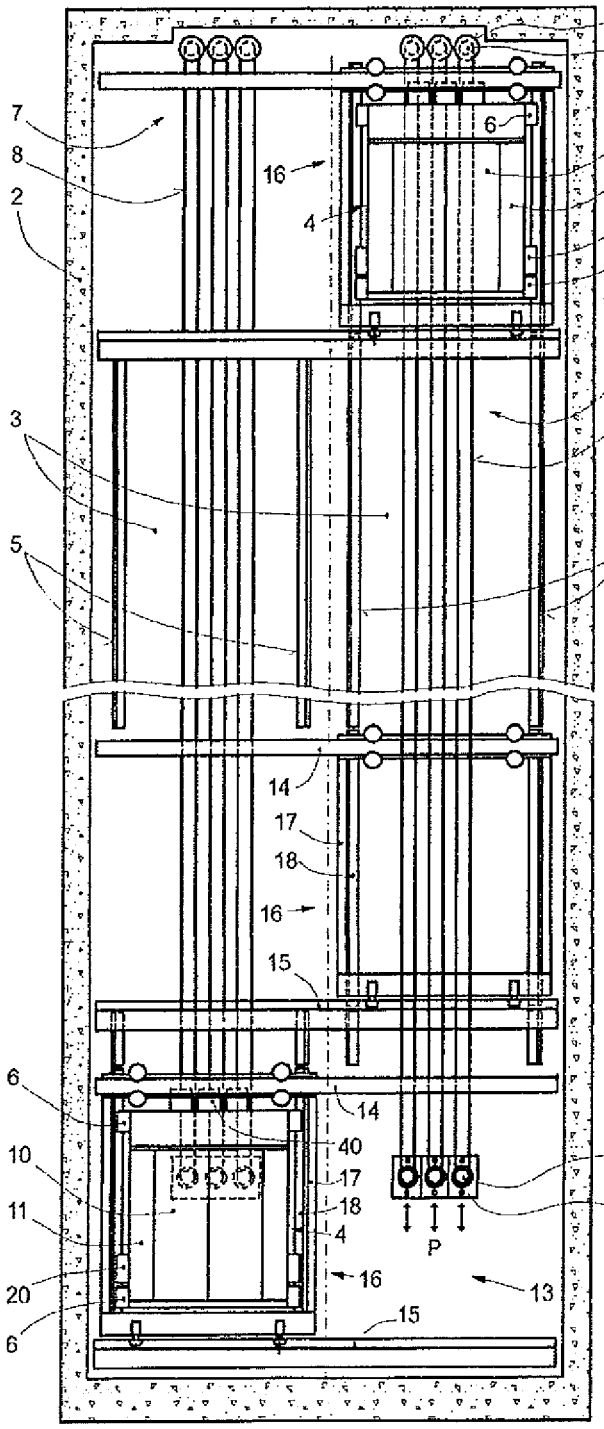
FIG. 1A shows a front view of an elevator system according to the invention with two vertical tracks, two elevator cars and three car transfer mechanisms, wherein the vertical tracks are arranged offset with respect to one another parallel to the car walls having the car doors.
Figure 1B:
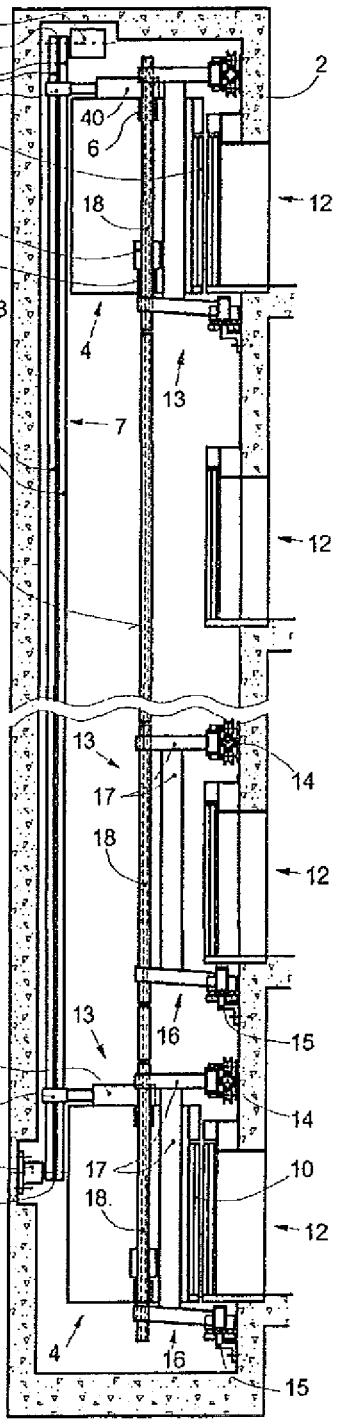
FIG. 1B shows a side view of the elevator system according to FIG. 1A.

FIGS. 1A and 1B respectively show a front view and a side view of a first embodiment of the elevator system according to the invention which comprises two vertical tracks 3 arranged in an elevator shaft 2 and two elevator cars 4 traveling along said vertical tracks. The vertical tracks 3 are formed by two lengths in each case of vertical guide rails 5 fastened in the elevator shaft, and the elevator cars 4 are guided along said vertical guide rails by means of guide shoes 6, there being in each case two guide shoes on each side of the elevator cars. Each vertical track 3 is equipped with three car drive systems 7 having revolving supporting means 8. Each of the elevator cars 4 can be coupled to the supporting means 8 of in each case one car drive system in order to convey the elevator car along a vertical track, and can also be decoupled from said supporting means in order to displace the elevator car from one vertical track to another. For this purpose, each elevator car is equipped with three controllable coupling mechanisms 40, each of which is assigned to one of the three car drive systems 7. As a variant, each elevator car may also have just one single coupling mechanism which is brought in each case prior to the coupling operation into a position corresponding to the presently assigned car drive system by means of a controlled positioning device. The car drive systems and the coupling mechanisms required are described further on in this document.

In this embodiment of the elevator system, the vertical tracks 3 are arranged offset with respect to one another parallel to the car walls 11 having the car doors 10. During normal operation, one of the vertical tracks 3 serves as a track for the upward trip and the other as a track for the downward trip of the elevator cars, wherein each of the elevator cars, after reaching a floor level in the end region of a vertical track, executes a horizontal transfer to the other vertical track on which the elevator car can continue to move in the reverse traveling direction.

Three car transfer mechanisms 13, with the aid of which the elevator cars are displaceable between the vertical tracks 3, are illustrated in each case in regions of floor stops 12. Each of the car transfer mechanisms comprises two horizontal guides 14, 15 which are fixed to the door-side wall of the elevator shaft 2, and a horizontal displacement unit 16 which is displaceable along said horizontal guides. A horizontal displacement unit of this type comprises a frame structure 17 in which two vertical guide rail pieces 18 are fixed, said guide rail pieces forming end sections or intermediate sections of the vertical guide rails 5 of the vertical tracks 3 when the horizontal displacement unit is positioned in a corresponding transit position. The frame structure 17 is designed in such a manner that the elevator cars 4 can pass in the vertical direction through the horizontal displacement unit 16, which is in the correct transit position, or can stop in said horizontal displacement unit, the elevator cars being guided on the abovementioned guide rail pieces 18.

The car transfer mechanisms 13 are equipped with a respective displacement drive (not illustrated here) which, controlled by means of an elevator controller, displaces the horizontal displacement units between the vertical tracks 3 and positions said horizontal displacement units in defined transit positions in which the integrated guide rail pieces 18 are precisely aligned with the vertical guide rails 5 of the vertical tracks. The horizontal displacement units may be empty during the displacement operation or loaded with an elevator car. The displacement drive may include, for example, a drive train, a toothed belt or a rack device via which a preferably speed-controllable electric motor displaces the horizontal displacement units and positions them in a transit position required at that moment. Centering devices may expediently be present on the horizontal displacement units 16, said centering devices fixing the horizontal displacement units precisely and rigidly in one of the transit positions, even when horizontal forces are in effect, for example with the aid of a centering wedge which engages in a controlled manner in a positionally fixed counterpiece.

Controllable brake mechanisms 20 are attached on both sides of the elevator cars 4, said brake mechanisms interacting with the vertical guide rails 5 and the guide rail pieces 18 of the horizontal displacement units 16 in such a manner that the brake mechanisms brake or secure the elevator cars when said brake mechanisms are activated by a control mechanism. Said brake mechanisms 20 are used to secure the elevator cars 4 on the guide rail pieces 18 integrated in the horizontal displacement units 16 while said elevator cars are being displaced between two vertical tracks 3. Said brake mechanisms 20 may advantageously also be used as catch devices which, in the event of the permissible car speed or the acceleration being exceeded, act as safety brakes acting between the elevator cars 4 and vertical guide rails 5. Said brake mechanisms may also serve as holding brakes which, during floor stops, prevent vertical oscillations and changes in the level of the elevator cars as a result of changes in load. The brake mechanisms 20 customarily contain brake plates which are pressed against the vertical guide rails by means of controllable actuators.

Various principles are suitable for realizing actuators of this type, for example lifting spindles with torque-controllable drive motors, hydraulic cylinders with pressure regulation, or solenoids which, in the activated state, adhere to the guide rails. In this case, the brake force generated is preferably regulated as a function of the elevator car deceleration measured by a deceleration sensor.

For safety reasons, controllable locking devices may be attached to the horizontal displacement units 16, said locking devices locking the transit of an elevator car by means of the horizontal displacement units in the downward direction and eliminating the risk of an elevator car dropping out of a horizontal displacement unit.

It can easily be seen that, in the embodiment of the elevator system illustrated in FIGS. 1A, 1B, in which the vertical tracks are arranged offset with respect to one another parallel to the car walls 11 having the car doors 10, a plurality of vertical tracks 3 may also be arranged next to one another. In this embodiment, entry and exit take place at floor stops 12 which may be located on each floor and may be assigned to each of the vertical tracks. The horizontal guides 14, 15 of the car transfer mechanisms 13 advantageously extend here over the entire width of all of the vertical tracks such that each elevator car can use each of the vertical tracks 3. In the case of elevator systems having a relatively large number of parallel vertical tracks, it may be expedient to allow more than one horizontal displacement unit 16 to operate on the same horizontal guides 14, 15 of a car transfer mechanism 13 or to arrange two or more car transfer mechanisms directly one above the other. Car transfer mechanisms may also be present on any intermediate level of the elevator system, said intermediate level not necessarily having to be located in the region of a floor stop. In combination with a correspondingly configured elevator controller, in an elevator system of this type elevator cars can change the vertical track thereof and, if appropriate, the traveling direction thereof via such car transfer mechanisms arranged on intermediate levels without having to complete a circuit via the end regions of the vertical tracks, or empty elevator cars can be called up from parallel vertical tracks without large detours and waiting times having to be accepted. One of the vertical tracks may advantageously be provided as a store or as a parking space for empty elevator cars. A car transfer mechanism 13 which is not arranged in an end region of the vertical tracks and has an empty horizontal displacement unit 16 is shown above the lowermost floor stop. A car transfer mechanism of this type may be arranged on any intermediate level of the elevator system. Owing to roller-mounted horizontal displacement units 16 and controllable displacement drives, the car transfer mechanisms 13 are also suitable for horizontally displacing elevator cars which are occupied by passengers.

Since the vertical guide rails 5 of the vertical tracks 3 are interrupted in the regions of the car transfer mechanisms 13, the elevator controller ensures that each time before an elevator car enters such a region, the guide rail pieces 18 of a horizontal displacement unit 16 span the interruptions. If no horizontal displacement unit is available at the right time for a required spanning, the elevator car is stopped before reaching the interrupted region.

Figures 2A, 2B:
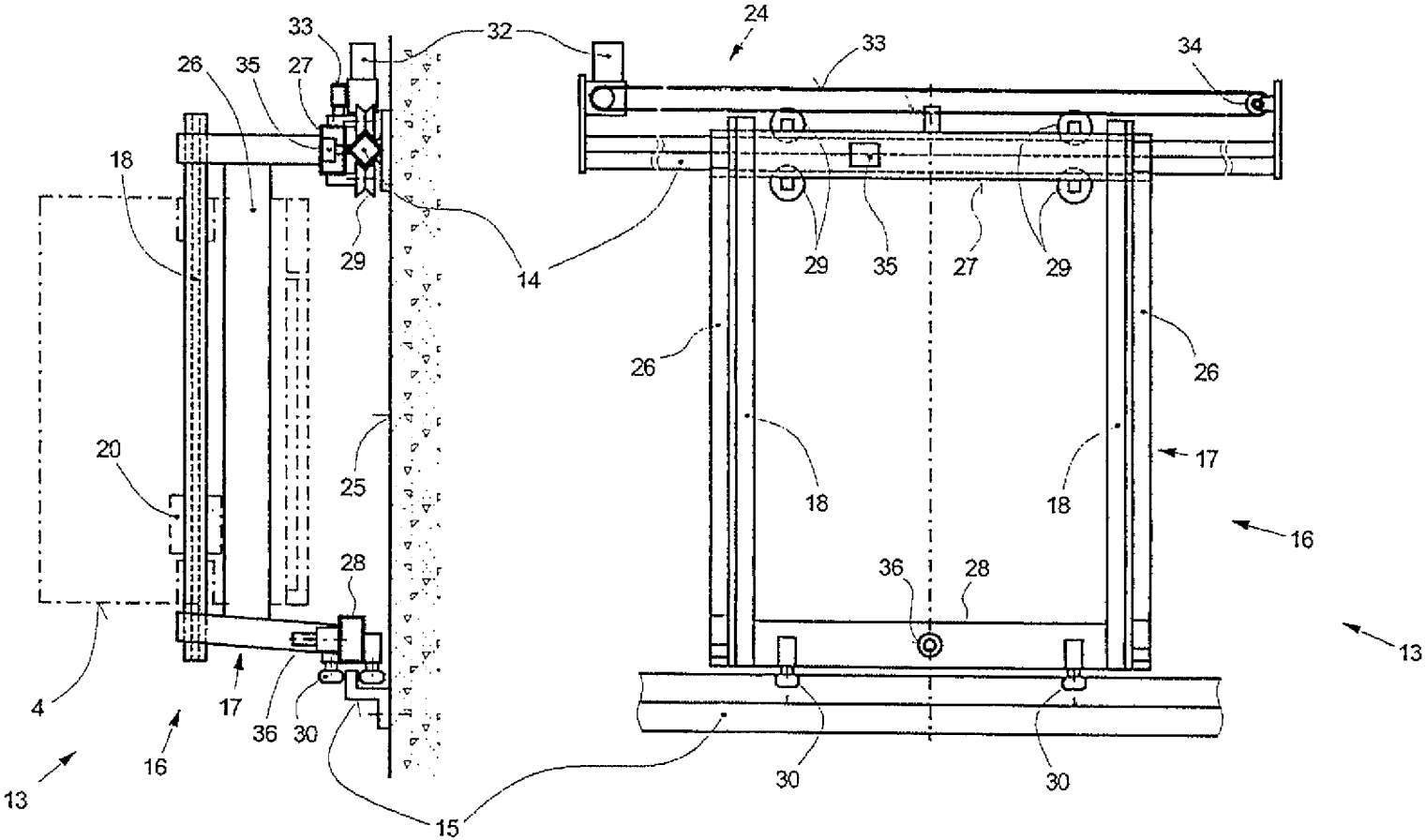
FIG. 2A shows, on an enlarged scale, a horizontal displacement unit of the above-mentioned car transfer mechanisms in side view.
FIG. 2B shows a front view of the horizontal displacement unit according to FIG. 2A.

FIG. 2A and FIG. 2B respectively show a side view and a front view of an above-described car transfer mechanism 13 together with the horizontal displacement unit 16 thereof in an enlarged illustration. To clarify the interaction of the horizontal displacement unit with the elevator cars 4, one such elevator car is indicated in a holding position in the horizontal displacement unit by means of ghost lines. An upper horizontal guide is denoted by 14 and a lower horizontal guide by 15, on which horizontal guides the horizontal displacement unit 16 can be displaced by a displacement drive 24 between the vertical tracks of the elevator system. The horizontal guides 14, 15 are fastened to the door-side wall 25 of the elevator shaft. The horizontal displacement unit 16 comprises a frame structure 17 with two vertically arranged side frames 26 and an upper longitudinal member 27 and a lower longitudinal member 28 which connect the two side frames 26 to each other. Four profiled, upper guide rollers 29 are fixed to the upper longitudinal member 27 and are used to guide the upper longitudinal member 27 in the vertical and horizontal direction on the upper horizontal guide 14. The lower longitudinal member 28 has four lower guide rollers 30 which guide the lower longitudinal member 28 in the horizontal direction on the lower horizontal guide 15. The vertically aligned guide rail pieces 18 already mentioned above are fixed to the inner sides of the two side frames 26. The two side frames 26 together with the upper and the lower longitudinal members 27, 28 form a U-shaped frame which permits the transit of elevator cars 4 between the two side frames 26, wherein the two guide rail pieces 18 form end sections or intermediate sections of the vertical guide rails of the vertical tracks of the elevator system when the horizontal displacement unit is positioned in a correct transit position. As likewise already mentioned, the elevator cars are equipped with controllable brake mechanisms 20 with which the elevator cars 4 can be secured on the abovementioned guide rail pieces 18 during a horizontal transfer between two vertical tracks.

The displacement drive 24 is arranged above the horizontal displacement unit 16 and comprises a belt drive which is fastened on the upper horizontal guide, extends over the entire displacement distance and has a drive unit 32, a revolving displacement belt 33 and a deflecting belt pulley 34, wherein the lower strand of the displacement belt is connected to the upper longitudinal member 27 of the horizontal displacement unit.

The drive units 32 of the horizontal displacement units 16 are preferably controlled by the central elevator controller which controls and monitors all of the elevator traffic.

The horizontal displacement unit 16 illustrated is equipped with a centering device which is shown schematically by the reference number 35. The centering device 35 can fix the horizontal displacement unit, for example, in one of the transit positions precisely and such that it is capable of bearing a load by the rough positioning by means of the displacement drive 24 being followed by engagement of an electromagnetically controlled centering wedge in a notch on the upper horizontal guide 14.

A controllable locking device is denoted by 36, said locking device locking the transit of an elevator car 4 by means of the horizontal displacement unit 16 in a downward direction and eliminating the risk of an elevator car dropping out of a horizontal displacement unit, for example should a brake mechanism fail. A locking device 36 of this type may comprise, for example, an electromagnetically controllable locking bolt which, controlled by the elevator controller, reaches out from at least one of the side frames 26 of the horizontal displacement unit 16 and engages under an elevator car fixed in the horizontal displacement unit for as long as said elevator car should not leave the horizontal displacement unit in the downward direction.

Figure 3A:
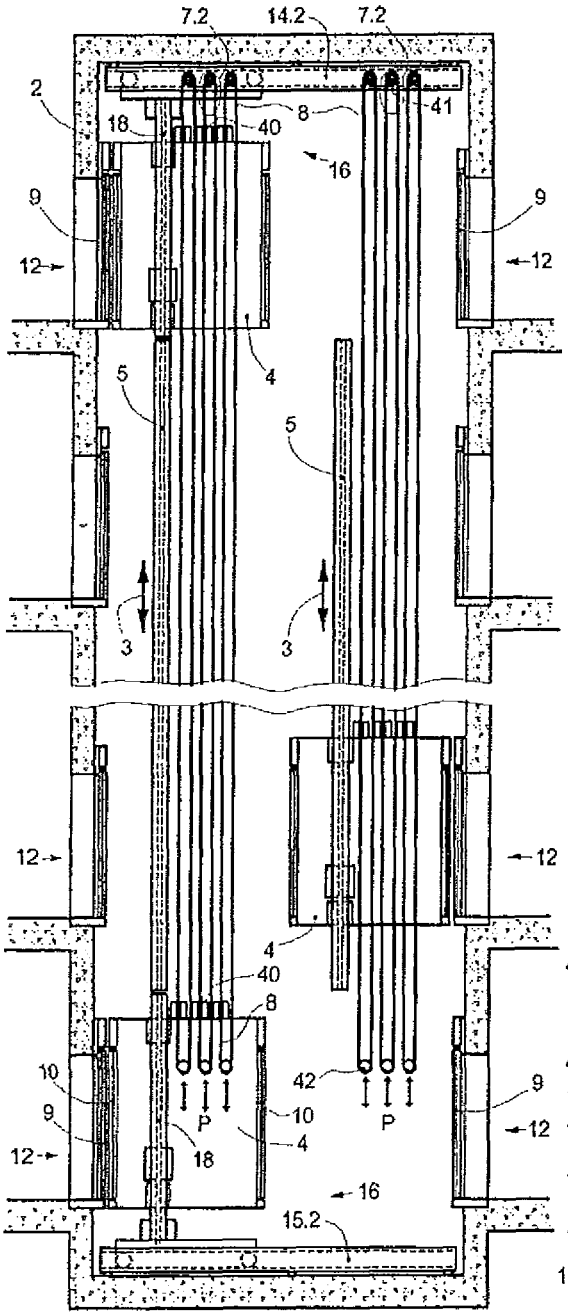
FIG. 3A shows a side view of an elevator system according to the invention with three vertical tracks, two elevator cars and two car transfer mechanisms, wherein the vertical tracks are arranged offset with respect to one another at right angles to the car walls having the car doors.
Figure 3B:
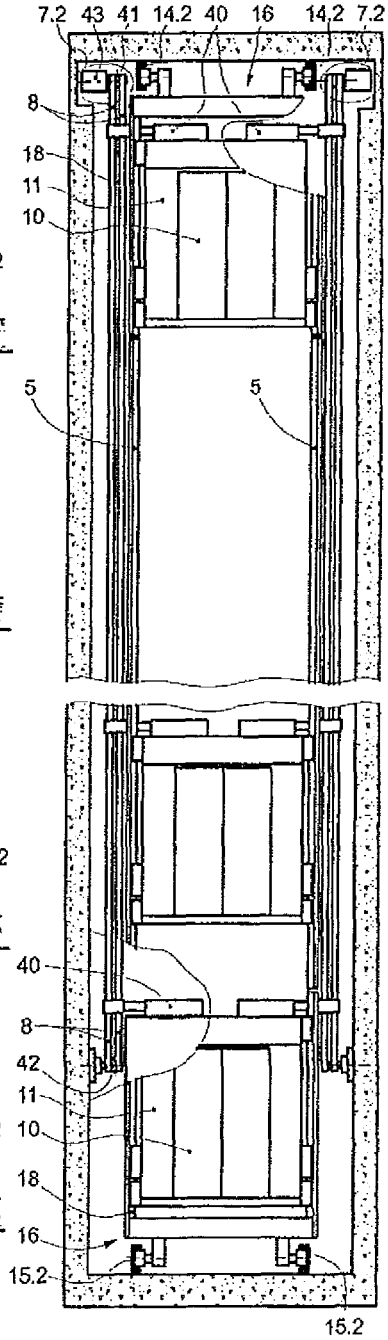
FIG. 3B shows a front view of the elevator system according to FIG. 3A.

FIG. 3A and FIG. 3B respectively show a side view and a front view of a second embodiment of the elevator system according to the invention, in which components acting in an identical manner are denoted by the reference numbers used in FIGS. 1A and 1B. Where required, the reference numbers for elements of the second embodiment are indicated by the index "0.2".

The embodiment illustrated comprises two vertical tracks 3 each having two vertical guide rails 5, and three elevator cars 4 traveling along said vertical tracks. In contrast to the above-described first embodiment, the vertical tracks 3 here are arranged offset with respect to one another at right angles to the car walls 11 having the car doors 10. The elevator cars each have two mutually opposite car doors 10 which each correspond to shaft doors 9 provided on mutually opposite walls of the elevator shaft. In this second embodiment, the horizontal displacement units 16 of the car transfer mechanisms 13 are displaced along horizontal guides 14.2, 15.2 which are respectively arranged below the lower ends and above the upper ends of the vertical tracks 3, for example on the floor and on the ceiling, respectively, of the elevator shaft 2. In said horizontal displacement units 16, the guide rail pieces 18 which are integrated therein likewise permit an elevator car 4 to be received in order for said elevator car to be displaced between two vertical tracks 3. Horizontal displacement units which are installed on intermediate levels and permit transit of the elevator cars are not provided in this embodiment. One advantage of this embodiment is that the floor stops 12 and the entry vestibules for upward trips and downward trips are located separately from one another on opposite sides of the elevator shaft, thus enabling a more orderly flow of traffic to be achieved. A disadvantage of this embodiment is that only two vertical tracks can be arranged in such a manner that it is possible to enter or leave the elevator cars traveling thereon from the floor stops. However, it is also possible and expedient here to arrange at least one additional vertical track between the two vertical tracks adjacent to the shaft doors 9, it being possible for the additional vertical track to serve as a store for elevator cars which are not currently in use and/or as a second track for the traveling direction presently having more traffic.

In this embodiment of the elevator system, the elevator cars 4 are driven by in each case two synchronously operating subsystems 7.2 of a respective car drive system, which subsystems are arranged on mutually opposite sides of the elevator cars, each subsystem 7.2 having two revolving supporting means 8. In total, there are six subsystems 7.2 which together form three car drive systems operating independently of one another, and each elevator car 4 is provided with a total of six coupling mechanisms 40, of which in each case three interact with the left-hand and three with the right-hand subsystems 7.2 of the car drive systems. The arrangement of in each case two subsystems 7.2 on both sides has the advantage that the in each case two synchronously controlled and regulated subsystems driving an elevator car do not generate a tilting moment which acts on the elevator car. However, the car drive systems could also be arranged only on one side of the elevator cars. The tilting moment generated by car drive systems which are arranged on one side and acting on the elevator cars can be compensated for by the guide forces between the vertical guide rails and the guide shoes of the elevator cars.

In both embodiments, in order to move and position the elevator cars along the vertical tracks thereof, each vertical track is assigned car drive systems which are controllable independently from one another. Said car drive systems permit an asynchronous, i.e. non-coupled movement of a plurality of elevator cars along the same vertical track, which affords substantial advantages with regard to transport capacity and traveling times in comparison to elevator systems having a plurality of elevator cars driven by a single car drive system. For this purpose, the elevator cars can be coupled with the aid of controllable coupling mechanisms (described further below) to flexible supporting means of a car drive system, which supporting means are temporarily assigned to the elevators cars by the elevator controller. Of course, an elevator system according to the invention may also be provided with more than or with less than three car drive systems which are independent from one another.

For safety reasons, each of the illustrated car drive systems 7 and 7.2 comprises at least two parallel, flexible supporting means 8 which are movable along the assigned vertical tracks and, preferably in the upper elevator region, loop around a driving pulley 41 and, in the lower region, loop around a deflecting pulley 42 or a second driving pulley. Each driving pulley 41 is driven by a drive unit 43 which preferably comprises a speed-controllable electric motor. The drive units 43, or the electric motors thereof, which are assigned in each case to one of the car drive systems 7 or 7.2 can be controlled and regulated independently of the other drive units associated with the same vertical track. The driving pulleys 41 have a small effective diameter of less than 100 mm, preferably an effective diameter of less than 80 mm, and the effect therefore achieved is that the required lifting forces can be generated in the supporting means 8 by electric motors having small dimensions which preferably drive the driving pulleys directly without intermediate transmission. In this case, the motor shafts of the electric motors and the associated driving pulleys may form an integral unit. The permissible loading of a car drive system may be increased by an upper and a lower drive unit each having a driving pulley being assigned in each case to one car drive system. An embodiment of this type is shown in FIGS. 1A, 1B. The electric motors of drive units of this type are controlled synchronously and are speed-controlled synchronously.

The driving or deflecting pulleys in the lower elevator region are equipped here with tensioning devices (illustrated symbolically by means of arrows P) with which the required pretensioning of the supporting means is produced and deviations in the original lengths of the supporting means which are closed per se and operationally induced plastic changes in length in the supporting means are compensated for. The required tensioning forces can preferably be produced using tensioning weights, gas-filled springs or metal springs.

The supporting means 8 illustrated in the elevator systems according to FIGS. 1A, 1B, 3A, 3B are in the form of belts. The latter are preferably designed as toothed belts or as V-ribbed belts and reinforced with tensile reinforcements in the form of wire cables, synthetic fiber cables or synthetic fiber tissues, and therefore said belts can convey an assigned elevator car 4 over a large number of floors without impermissible vertical oscillations occurring.

As already mentioned above, each elevator car 4 of the illustrated elevator system is equipped with controllable coupling mechanisms 40 which permit a respective elevator car 4 to be coupled to a temporarily assigned car drive system 7 or to a subsystem 7.2 and, of course, also to be decoupled therefrom. A coupling mechanism of this type may have at least one controllably movable coupling element which interacts in an interlocking manner with openings or bosses present on the at least one supporting means of the assigned car drive system in order to produce a temporary connection between an elevator car and the supporting means. Although coupling mechanisms of this type ensure secure connections, they have the disadvantage that, prior to each coupling operation, the supporting means has to be brought into a position in which one of the openings or one of the bosses takes up a position corresponding to the movable coupling element of the car-side coupling mechanism. Prior to the decoupling, it is also expedient to relax the supporting means by means of appropriate activation of the drive unit after the elevator car is retained in a horizontal displacement unit in order to permit a load-free uncoupling of the interlocking connection and to avoid a sudden unloading of the relatively elastic supporting means.

On each elevator car, there are therefore expediently as many coupling mechanisms acting in a frictionally engaged manner as there are car drive systems 7 or subsystems 7.2 per vertical track. As a variant, each elevator car may also have just a single coupling mechanism which is brought in each case, prior to the coupling operation, by means of a controlled positioning device into a position corresponding to the car drive system presently assigned.

The coupling mechanisms 40 are preferably equipped with controllable clamping devices 45 with which in each case one of the coupling mechanisms of an elevator car can be connected in a frictionally engaged manner to at least one supporting means 8 of a temporarily assigned car drive system 7 or of a subsystem 7.2. So that an elevator car 4 can be displaced horizontally when it is fixed to the guide rail pieces 18 of a horizontal displacement unit 16, the clamping devices 45 of the coupling mechanisms 40 thereof can be pulled back out of the region of the supporting means 8. Coupling mechanisms which act in a frictionally engaged manner have the advantage that the elevator cars can be coupled to the supporting means of a car drive system in every vertical position without any coupling elements of the supporting means having to be brought beforehand to a defined position in relation to the elevator car. In addition, it is not necessary to relax the supporting means prior to the uncoupling in the case of coupling mechanisms acting in a frictionally engaged manner.

An exemplary embodiment of a coupling mechanism 40 acting in a frictionally engaged manner is described below in conjunction with FIGS. 4-7.

Figures 4, 5:
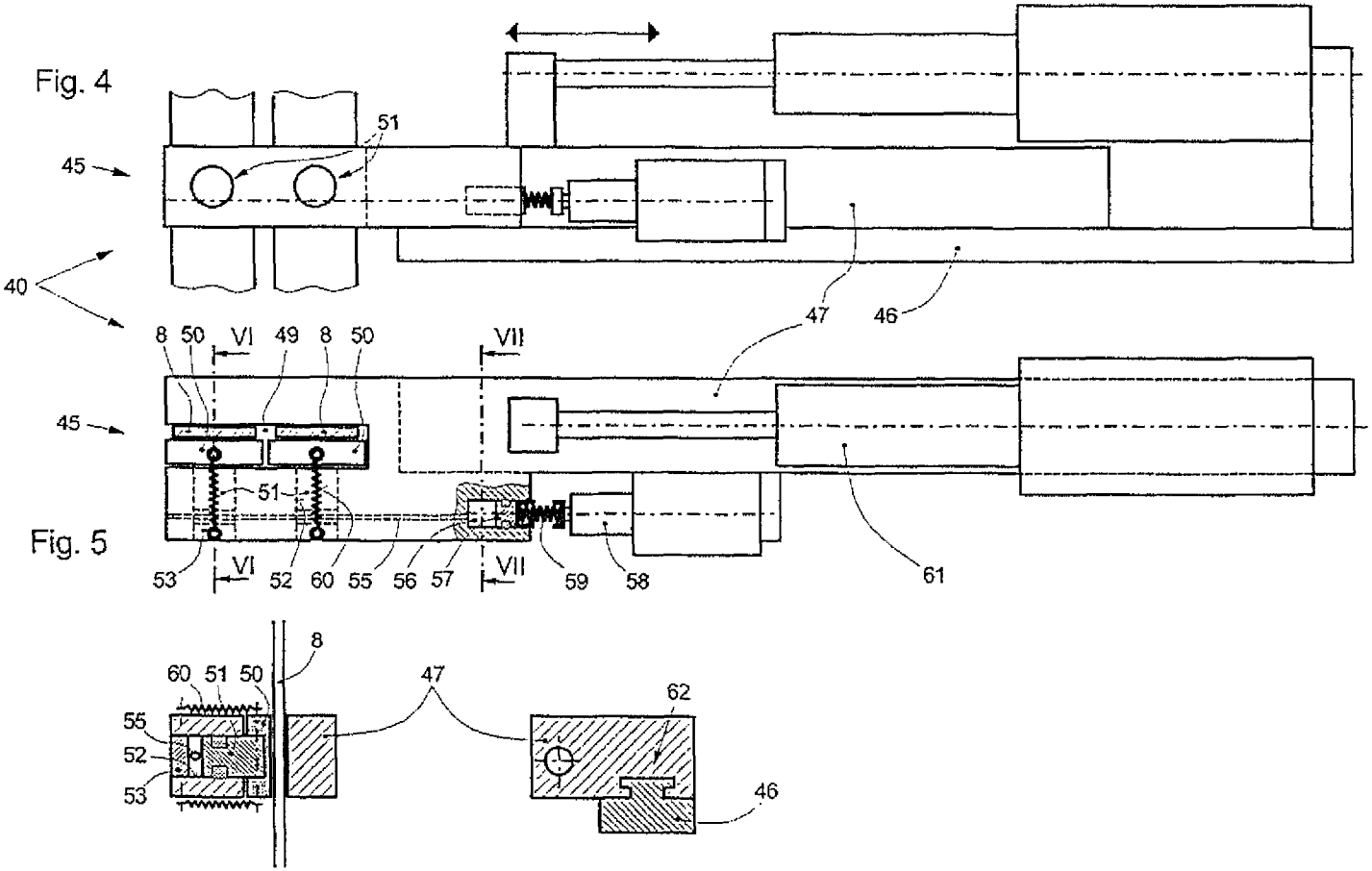

FIG. 4 shows a side view and FIG. 5 a top view of a coupling mechanism 40. As illustrated schematically in FIGS. 1A, 1B and 3A, 3B, a plurality of such coupling mechanisms are mounted on the upper sides of the elevator cars. FIGS. 6 and 7 respectively show cross sections through a clamping device 45 of the coupling mechanism and through a region of the coupling mechanism that is provided with a longitudinal guide which permits the coupling mechanism to be pulled back. The coupling mechanism 40 comprises a base plate 46 connected to the elevator car and a coupling part 47 which is displaceable on the base plate. The coupling part 47, in the region of the front end thereof, has a clamping device 45 which comprises a slot 49 through which the two supporting means 8 designed as belts are guided when the coupling part 47 takes up the extended position thereof. Two brake plates 50 are arranged in the slot 49 of the clamping device 45, each of which brake plates is guided by means of a pressing piston 51 and can be pressed by the latter against the assigned supporting means 8. As illustrated in FIG. 6, the two pressing pistons 51 are arranged in respective cylinder bores 52 which are drilled in one of the arms of the clamping device 45 and are closed on one side by a sealing stopper 53. The pressure spaces present in the two cylinder bores 52 between the pressing pistons and the sealing stoppers 53 are connected to an oil-filled pressure cylinder bore 56 by a connecting bore 55. Oil from said pressure cylinder bore can be pressed into the abovementioned pressure spaces by displacement of a pressure-generating piston 57 in order, by means of the pressing pistons 51, to press the brake plates 50 against the supporting means 8 and therefore to couple the latter in a frictionally engaged manner to the coupling part 47 and therefore to the elevator car. In order to displace the pressure-generating piston 57, a lifting spindle 58 which is operated by an electric motor is mounted laterally on the coupling part 47 and, via a spring element 59 and the pressure-generating piston 57, generates the oil pressure required for the coupling. For uncoupling purposes, the spring element is relieved of load by the lifting spindle 58, and therefore the pressing pistons 51 are pulled back by restoring springs 60 and the brake plates 50 are therefore lifted off the supporting means 8. So that an elevator car can be displaced horizontally when it is fixed on the guide rail pieces of the horizontal displacement unit, the clamping device 45 of the coupling part 47 can be pulled back out of the region of the supporting means 8. For this purpose, the coupling part 47 is connected displaceably in the longitudinal direction to the base plate 46 thereof via a T-shaped longitudinal guide 62. In the coupling mechanism 40 illustrated in FIGS. 4 to 7, the coupling part 47 and therefore the clamping device 45 are pulled back and advanced by means of a further displacement lifting spindle 61 driven by an electric motor.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system having an elevator car that moves along a first vertical track, moves along a second vertical track horizontally offset from the first vertical track, and moves horizontally with a car transfer mechanism between the first vertical track and the second vertical track, the first and second vertical tracks being positioned within a shaft, the elevator system comprising:

each of the first and second vertical tracks including a separate car drive system having a flexible supporting means, each of the supporting means extending continuously between opposite ends of an associated one of the vertical tracks and being movable and stoppable along the associated one of the vertical tracks with the elevator car at floor stops;

the elevator car having a controllable coupling mechanism for coupling to and decoupling from each of the supporting means, the supporting means supporting and moving the elevator car in the shaft when coupled;

each of the first and second vertical tracks including a vertical guide rail for guiding the elevator car, the vertical guide rails each having an interruption section and the interruption sections being horizontally aligned;

the car transfer mechanism having a horizontal displacement unit with a vertical guide rail piece, the guide rail piece guiding the elevator car in the horizontal displacement unit and, when the car transfer mechanism is positioned in either of the first and second vertical tracks, spanning the interruption section in the associated vertical guide rail, the horizontal displacement unit when positioned in defined horizontal transit positions of the elevator car having the vertical guide rail piece directly aligned with the vertical guide rails of the vertical tracks; and the elevator car having a brake mechanism for temporarily fixing to the guide rail piece.

2. The elevator system according to claim 1 wherein the brake mechanism is activated and deactivated by a control mechanism.

3. The elevator system according to claim 2 wherein the brake mechanism is operable as a catch brake for the elevator car.

4. The elevator system according to claim 2 wherein the brake mechanism is operable as a holding brake for the elevator car.

5. The elevator system according to claim 1 wherein the first and second vertical tracks each include two of the vertical guide rails and the elevator car is displaceable between the vertical guide rails of the first and second vertical tracks utilizing the car transfer mechanism.

6. The elevator system according to claim 5 wherein the first and second vertical tracks are offset with respect to each other parallel to a car wall of the elevator car, the car wall having a car door.

7. The elevator system according to claim 5 wherein the horizontal displacement unit of the car transfer mechanism is displaceable along horizontal guides which are arranged parallel to a car wall of the elevator car having a car door in a part of an elevator shaft which is not taken up by the vertically and horizontally moving elevator car.

8. The elevator system according to claim 5 wherein the elevator car has two mutually opposite car walls each having a car door and the first and second vertical tracks are arranged offset with respect to each other at right angles to the car walls.

9. The elevator system according to claim 1 including a plurality of the car transfer mechanism, each of the car transfer mechanisms being arranged on a different vertical level and having one of the guide rail piece that spans an associated one of the interruption section in the vertical guide rails, each of the interruption sections being one of an end section and an intermediate section of the vertical guide rail.

10. The elevator system according to claim 1 wherein the supporting means and the coupling mechanism cooperate to couple the elevator car and the supporting means by interlocking engagement.

11. The elevator system according to claim 1 wherein the supporting means and the coupling mechanism cooperate to couple the elevator car and the supporting means by frictional engagement.

12. The elevator system according to claim 1 wherein the drive system includes a drive unit with a speed-controllable electric motor, the electric motor driving a driving pulley or a driving shaft acting on the supporting means, the driving pulley or the driving shaft having a diameter of less than 100 mm.

13. The elevator system according to claim 1 wherein the drive system comprises three flexible supporting means arranged parallel.

14. The elevator system according to claim 1 wherein the drive system includes an upper drive unit and a lower drive unit, which units are controlled and regulated synchronously and jointly act on the supporting means.

15. The elevator system according to claim 1 wherein the supporting means is at least one of a wire cable, a flat belt, a V-ribbed belt and a toothed belt.

16. The elevator system according to claim 1 wherein the coupling mechanism couples by frictional engagement and includes a clamping device that is movable away from the supporting means to permit a horizontal transfer of the elevator car.

17. The elevator system according to claim 1 wherein the drive system operates without a counterweight.

18. The elevator system according to claim 1 wherein the drive system includes a drive regulator which, during a downward trip of the elevator car, feeds electrical energy generated into power mains or stores the energy in a capacitor or an accumulator.

19. The elevator system according to claim 1 wherein the first and second vertical tracks are equipped with at least two of the drive system arranged parallel to one another so at least two elevator cars can move simultaneously along each of the first and second vertical tracks, the elevator cars each having one of the controllable coupling mechanism with which the elevator cars couple separately to different ones of the at least two drive systems.

20. An elevator system comprising:

two vertical tracks positioned in an elevator shaft and each having a vertical guide rail;

two elevator cars each movable vertically along the vertical tracks and movable horizontally between the vertical tracks with a car transfer mechanism;

a separate car drive system in each of the vertical tracks for each of the elevator cars and having a plurality of flexible supporting means, each of the supporting means extending continuously between opposite ends of an associated one of the vertical tracks and being movable and stoppable along the associated one of the vertical tracks with the elevator cars at floor stops;

each of the elevator cars having a controllable coupling mechanism with which the elevator cars are coupled to or decoupled from an associated one of the supporting means, the supporting means supporting and moving the elevator cars when coupled;

the car transfer mechanism having a horizontal displacement unit with a vertical guide rail piece, the guide rail piece guiding an associated one of the elevator cars in the horizontal displacement unit, and when the horizontal displacement unit is positioned in one of the vertical tracks the guide rail piece spans an interruption section of the associated vertical guide rail, the horizontal displacement unit when positioned in defined horizontal transit positions of the elevator car having the vertical guide rail piece directly aligned with the vertical guide rails of the vertical tracks; and each of the elevator cars having a brake mechanism for temporarily fixing to the guide rail piece when the elevator car is positioned in the horizontal displacement unit.

21. A method for operating an elevator system in which an elevator car is moved along spaced apart vertical tracks and is displaced horizontally by a car transfer mechanism between the vertical tracks, the vertical tracks being positioned within a shaft, wherein a controllable coupling mechanism couples the elevator car to and decouples the elevator car from a separate car drive system of each of the vertical tracks, comprising the steps of:

providing each of the car drive systems with a flexible supporting means extending continuously between opposite ends of the associated one of the vertical tracks and being movable and stoppable along the associated one of the vertical tracks with the elevator car at floor stops, the supporting means supporting and moving the elevator car when coupled, providing a guide rail piece in a horizontal displacement unit of the car transfer mechanism, the guide rail piece selectively spanning an interruption section of a vertical guide rail in each of the vertical tracks;

directly aligning the vertical guide rail piece with the vertical guide rails of the vertical tracks when the horizontal displacement unit is positioned in defined horizontal transit positions of the elevator car;

moving the elevator car along one of the vertical tracks and onto the guide rail piece with the elevator car coupled to the supporting means;

fixing the elevator car to the guide rail piece by a brake mechanism attached to the elevator car;

decoupling the elevator car from the supporting means;

moving the horizontal displacement unit with the guide rail piece and the elevator car away from the one vertical track in a horizontal direction and to another one of the vertical tracks; and coupling the elevator car to the supporting means associated with the another one of the vertical tracks.

* * * * *